US005605144A

United States Patent [19]

Simmons et al.

[11] Patent Number: 5,605,144

[45] Date of Patent: Feb. 25, 1997

[54] HEATING GARMENT WITH POUCH FOR ACCOMMODATING INSERTED HEATING PACKETS

[75] Inventors: John J. Simmons; Jane Simmons; Steve Simmons, all of Bismarck, N. Dak.

[73] Assignee: Thermo-Cool Products Inc, Bismarck, N. Dak.

[21] Appl. No.: 224,437

[22] Filed: Apr. 8, 1994

Related U.S. Application Data

[63] Continuation-in-part of Ser. No. 986,680, Dec. 8, 1992, Pat. No. 5,302,806.

[51] Int. Cl.[6] ..... A61F 7/00

[52] U.S. Cl. ..... 126/204; 126/263.02; 607/109; 607/114; 2/171.2

[58] Field of Search ..... 219/211, 212, 219/527, 529, 548, 549; 126/204, 263 R, 263.02; 607/108, 114, 109, 110, 139, 140; 2/10, 171.2

[56] References Cited

U.S. PATENT DOCUMENTS

| | | | |
|---|---|---|---|
| 1,567,931 | 12/1925 | Epler | 607/109 |
| 1,970,081 | 8/1934 | Eisendrath | 2/158 |
| 2,403,676 | 7/1946 | Modlinski | 2/94 |
| 2,579,620 | 12/1951 | Smith | 126/208 |
| 3,465,120 | 9/1969 | Merna | 219/211 |
| 3,500,014 | 3/1970 | Longo | 219/211 |
| 3,501,616 | 3/1970 | Arron | 219/211 |
| 3,663,797 | 5/1972 | Marsh | 219/211 |
| 3,839,621 | 10/1974 | Hariu | 607/109 |
| 3,882,873 | 5/1975 | Arango | 128/379 |
| 3,950,789 | 4/1976 | Konz et al. | 2/93 |
| 3,976,049 | 8/1976 | Yamashita | 126/263 |
| 3,988,568 | 10/1976 | Mantell | 607/109 |

FOREIGN PATENT DOCUMENTS

| | | | |
|---|---|---|---|
| 319597 | 3/1902 | France | 607/108 |
| 59-185942 | 10/1984 | Japan | 126/204 |
| 460200 | 1/1937 | United Kingdom | 607/109 |
| 500270 | 4/1937 | United Kingdom | 607/109 |
| 466141 | 5/1937 | United Kingdom | 607/109 |
| 469769 | 8/1937 | United Kingdom | 607/109 |
| 2130489 | 6/1984 | United Kingdom | 607/110 |
| 9201429 | 2/1992 | WIPO | 607/114 |

OTHER PUBLICATIONS

Commercial Product: Jon–E® Warmer, Aladdin Industries, Minneapolis, MN.

Commercial Product: Heating packet formed from plastic film containing iron powder, salt, water, wood fiber and charcoal; e.g. Hothands–2™ by Heatmax, Dalton, GA.

Exhibit A: Cozy Stuff™ Heated Headband.

Exhibit B: Photocopy of Headband Warmer.

Exhibit C: Photocopy of reverse side of Exhibit B.

Exhibit D: 9–page catalog of Heat® Factory '93–'94.

Healthcore "Omnipak" advertisement, Healthcore, 281 Albany Street, Cambridge, MA 02139.

*Primary Examiner*—John A. Jeffery

*Attorney, Agent, or Firm*—James V. Harmon

[57] ABSTRACT

A garment applies heat to the neck, head or torso with air-activated chemical heating packets. The garment is formed from cloth and is preferably soft and sufficiently supple to conform to the body contours during use. The garment has at least one pouch positioned between two layers of cloth for holding the air-activated heat-producing packet. A layer of cloth between the heating packet and the body is a high pile cloth with air-trapping qualities for diffusing heat supplied by the heating packet to distribute the heat evenly to the body for assuring comfort for the user. In one form of the invention, the garment comprises a neck wrap, scarf, bandanna, a head covering in the form of a hat liner, or a cap insert. The neck wrap, scarf or bandanna includes an elongated pouch for holding the heating packet and has overlapping ends that can be fastened together by means of hook-and-loop fasteners. The head covering has side, rear and top portions, a face opening, and includes pouch positioned to hold the heating packets next to the ears of the user.

(List continued on next page.)

12 Claims, 7 Drawing Sheets

U.S. PATENT DOCUMENTS

| | | | |
|---|---|---|---|
| 4,033,354 | 7/1977 | De Rosa | 128/379 |
| 4,061,897 | 12/1977 | Thykeson | 219/211 |
| 4,190,054 | 2/1980 | Brennan | 607/109 |
| 4,204,543 | 5/1980 | Henderson | 607/109 |
| 4,326,533 | 4/1982 | Henderson | 128/402 |
| 4,425,917 | 1/1984 | Kuznetz | 607/110 |
| 4,512,830 | 4/1985 | Hulett et al. | 219/527 |
| 4,532,410 | 7/1985 | Wehmeyer | 219/211 |
| 4,576,169 | 3/1986 | Williams | 128/402 |
| 4,676,247 | 6/1987 | Van Cleve | 128/402 |
| 4,688,572 | 8/1987 | Hubbard et al. | 128/402 |
| 4,777,344 | 10/1988 | Nash et al. | 219/211 |
| 4,832,030 | 5/1989 | DeCanto | 128/380 |
| 4,972,832 | 11/1990 | Trapini et al. | 128/402 |
| 5,005,374 | 4/1991 | Spitler | 62/259.3 |
| 5,020,711 | 6/1991 | Kelley | 224/222 |
| 5,038,779 | 8/1991 | Barry et al. | 128/402 |
| 5,072,598 | 12/1991 | Dibrell | 62/259.3 |
| 5,088,549 | 2/1992 | Schneider | 165/46 |
| 5,146,625 | 9/1992 | Steele et al. | 2/102 |
| 5,148,804 | 9/1992 | Hill et al. | 128/402 |
| 5,197,292 | 3/1993 | McPherson | 607/109 |
| 5,230,333 | 7/1993 | Yates et al. | 2/239 |
| 5,295,949 | 3/1994 | Hathaway | 607/109 |
| 5,305,470 | 4/1994 | McKay | 607/109 |
| 5,395,400 | 3/1995 | Stafford et al. | 607/109 |
| 5,484,448 | 1/1996 | Steele et al. | 607/109 |

HEATING GARMENT WITH POUCH FOR ACCOMMODATING INSERTED HEATING PACKETS

This application is a continuation-in-part of a prior application Ser. No. 07/986,680 filed Dec. 8, 1992, now U.S. Pat. No. 5,302,806 dated Apr. 12, 1994.

FIELD OF THE INVENTION

This invention relates to garments and more particularly to garments used for applying heat to the body to provide warmth and comfort for the user during cold weather.

BACKGROUND OF THE INVENTION

While a variety of body heating devices have been previously proposed, the present invention concerns personal garments that greatly improve the usefulness and efficiency of certain chemical reaction-type heating devices, especially air-activated, disposable heating devices, e.g., flexible packets that contain a mixture of iron powder, activated charcoal, salt, water and wood fibers such as products marketed under the trade name HOTHANDS-2™ by Heatmax, Inc., P.O. Box 1191, Dalton, Ga. When these packets are opened and air is allowed to enter the packet, an exothermic chemical reaction takes place between the components, increasing the temperature of the packet to about 130° F. to 140° F. Current methods of using the heat-producing flexible packets are inconvenient, clumsy and inefficient. The packets are ordinarily placed in a glove, mitten, or shoe, or in a pocket, e.g., a jacket pocket, to provide warmth to the hands when the hands are placed in the pocket next to the heated packet. Primarily because a jacket is loose on the body little, if any, heat is conducted to the chest or abdomen for warming the core of the body. When placed in a mitten, the heat-producing packet can be wrapped in protective fabric such as a cloth handkerchief. This is awkward and inconvenient. In addition, the packet can become unwrapped and cause overheating of the skin. Another means of using such a packet is to place an adhesive or sticky tape on one side of it and attach the packet to the area of a body garment where warmth is desired. However, packets bonded to garments sometimes fall off after only a short use period and attempts to re-stick the packet are usually unsuccessful because the adhesive is often lost or dried up.

It is well known that other types of personal heating units, e.g., a rigid heater known as the JON-E® handwarmer manufactured by Aladdin Laboratories, Inc., Minneapolis, Minn. (U.S. Pat. No. 2,579,620) have been developed. This heater uses a petroleum distillate and a special wick within a metal container wrapped in a cloth bag for warming purposes. Again, the manufacturer recommends that this warmer be placed in a pocket such as a jacket pocket to provide warmth for the hands. In this mode of use, much of the heat is dissipated to the air, and only a small fraction of the heat is conducted to the hands so as to effectively warm the person's hands when the hands are placed in the pocket. Only an insignificant amount of heat, if any, is conducted to the chest or abdomen from the jacket pocket and therefore this mode of use fails completely to elevate the body core temperature which is an important objective of the present invention. These distillate burning units require an open flame to initiate heating and are also heavy and smelly during use. Consequently, the air-activated heating packet described above is preferred for use in the present invention because it is lightweight, flexible, and provides odorless heating. However, prior to the development of the present invention, much of the heat produced by this kind of air-activated, flexible packet was wasted due to the lack of an effective means to efficiently conduct heat to specifically designated parts of the body.

In view of these and other deficiencies of the prior art, it is one object of the present invention to provide garments specifically designed to carry and hold one or more heat-producing packets next to the body at specific locations that provide the user with desired warmth while also providing efficient transfer of heat to the core of the body and improved comfort for the user.

It is another object of the present invention to provide a means whereby a used heating packet may be easily and conveniently removed and replaced with a new heating packet.

It is a further object of the invention to provide a garment that will hold a heating packet close to the body while a person is engaged in physical activity such as hunting, skiing or working and to achieve effective operation and efficient heat transfer throughout a wide range of body movements.

Another object of the invention is to provide a garment designed in such a way that the layer of fabric placed between the body and the heating packet acts as a partial insulating layer to prevent overheating or burning the skin yet at the same time allows heat to be transferred to the body in a comfortable manner.

It is still another object of the invention to provide a garment with heat-producing capability that it will also provide warmth to the user when the capacity of the heat-producing packet is used up or during periods that are not sufficiently cold as to require the use of a heat-producing packet.

These and other more detailed and specific objects of the present invention will be apparent in view of the following description setting forth by way of example but a few of the various forms of the invention that will be apparent to those skilled in the art once the principles described herein are understood.

SUMMARY OF THE INVENTION

While in the past particular emphasis has been given to warming the body extremities, particularly the hands and feet, the present invention is directed especially toward the provision of an effective means for transferring heat from an air-activated chemical heating packet directly to the body core by heating the head, neck or torso. In accordance with the present invention, a garment is provided for heating the body core by applying heat to any of the neck, head or torso or combination thereof by means of an air-activated chemical heating packet. The invention provides a garment article formed from cloth. It is flexible, preferably soft and sufficiently supple to conform to the body contours during use. The garment includes two layers of fabric lying adjacent to one another. A pouch is provided between these layers of cloth for holding the air-activated heat-producing packet. One of the layers of cloth is positioned between the body and the packet. The garment is constructed and arranged to hold the pouch adjacent to the body core so that the pouch is in heat-conductive relationship with the body for transferring heat from the packet to the body core, whereby the heat so transferred to the body core can be distributed throughout the entire body including the extremities due to the circulation of blood through the body.

The invention has several forms. In one form, the garment comprises a shirt or vest-like garment with one or more pouches positioned to hold the packets in heat conductive relationship with the heart/lungs and abdomen. In another form of the invention, the garment comprises a strip or wrap that encircles the head or neck, and in another, a cloth hat liner for keeping the head warm. The wrap and hat liner also include a pouch for holding the air-activated heating packet in heat conductive relationship with the neck or with the head. An opening, e.g., a slit, is provided in the garment for inserting and removing the heating packet from the pouch.

In a preferred form of the invention, the garment includes a layer of cloth as a wall of the pouch. This layer of cloth is placed between the heating packet and the body and is formed from a soft, high pile fabric for diffusing and modulating the heat as it is transferred from the packet to the body.

When the garment comprises a neck wrap, scarf or bandanna, the garment has a specifically designed pouch that allows the user to shift the heating packet so as to position the heating packet in a desired location where heat can be efficiently transferred to the body, especially in locations on the body where there is good blood circulation that will efficiently transfer heat to the core of the body and thereby help to prevent discomfort due to a general cooling of the body, i.e., hypothermia. In one form of the invention, heat is transferred to the neck, especially at the back of the neck adjacent to the cervical vertebra to make use of blood circulation through the neck, especially via the carotid artery to carry heat to the body.

In other forms of the invention, the heating packet is positioned to efficiently transfer heat to the body in the heart/lung area, i.e., the chest and upper abdomen to warm the center, i.e., the core of the body from which it is carried to the extremities by circulation of the blood.

The invention will now be described in more detail by way of example with reference to the accompanying figures.

THE FIGURES

DETAILED DESCRIPTION OF THE INVENTION

Figure 1:
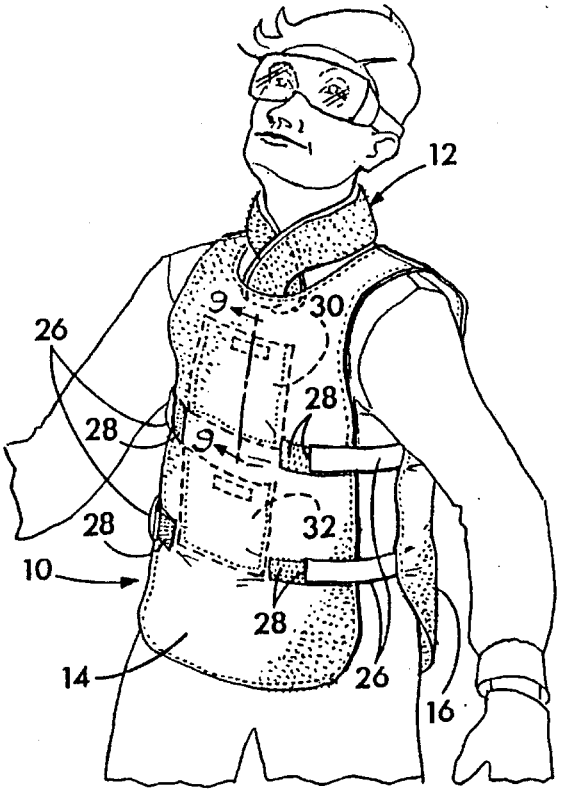
FIG. 1 is a perspective left side view of two forms of the invention comprising a heated vest and heated neck wrap.
Figure 2:
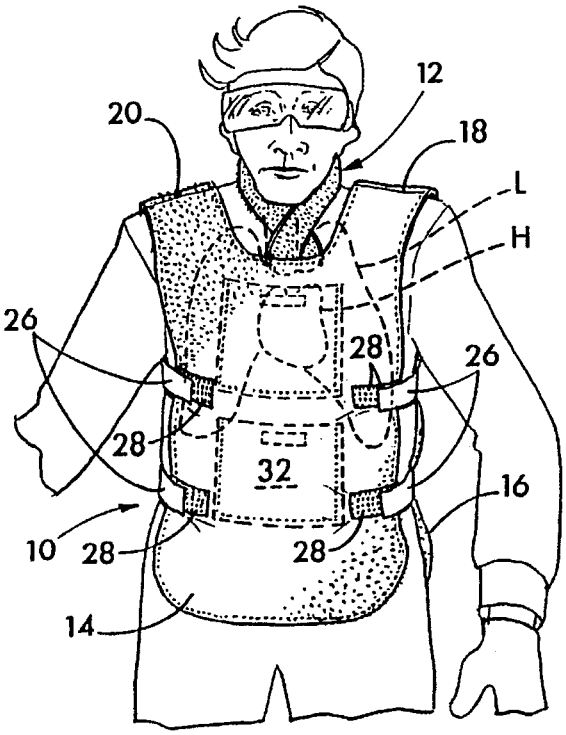
FIG. 2 is a front perspective view of FIG. 1.
Figure 3:
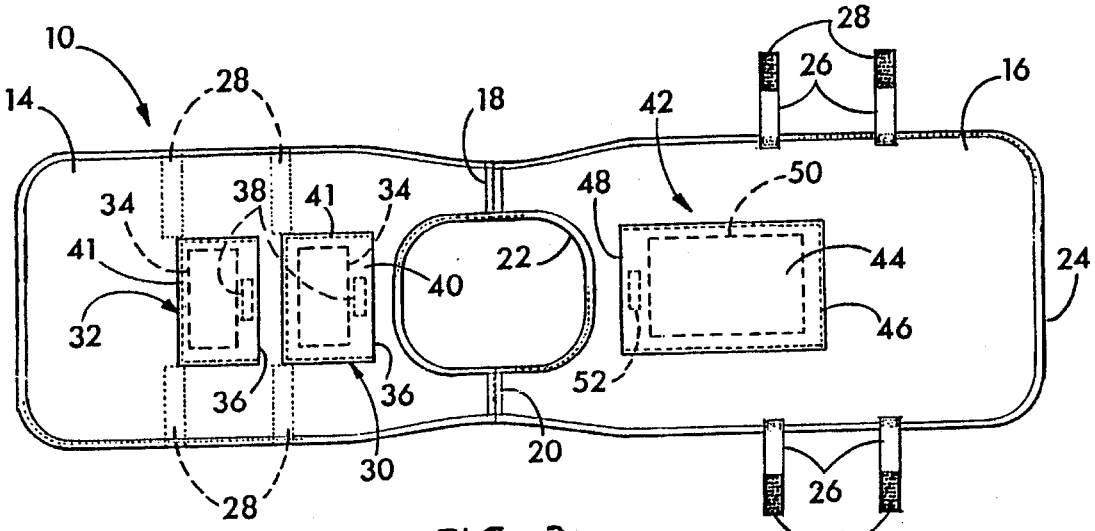
FIG. 3 is a plan view of the heated vest illustrated in FIGS. 1 and 2.

Refer now to FIGS. 1–3 which illustrate two forms of the invention: a heated vest 10 and a neck wrap 12 which for convenience have been shown in the same illustration (FIGS. 1 and 2) but which in practice can be used separately or, if desired, together as illustrated. The heated vest 10 will be described first with reference to FIGS. 1–3.

In this embodiment, the fabric is cut to form two generally rectangular panels including a generally rectangular front panel 14 and a generally rectangular back panel 16 which are sewn together at 18 and 20 to form shoulder sections on either side of a cutout opening 22 for the head that can measure about B inches by 10 inches. The fabric panels together form a vest 10. The edges of the vest 10 can be hemmed at 24. To hold the vest 10 firmly and securely against the body, the back panel 16 is provided with four straps 26. The straps 26 and corresponding aligned portions of the front panel 14 are provided with fasteners, e.g., mating hook-and-loop fasteners such as Velcro® fastening strips 28, for holding the vest 10 close to the body. Other retaining means can be used in place of the straps 28 for holding the vest 10 firmly against the body. Examples are elastic panels, elastic bands or the provision of a snug fit, in which case the vest 10 is made to pull down over the head and body. In that form of the invention, the means for holding the heated pouch firmly against the body comprises sizing the vest 10 so that it fits snugly but comfortably about the torso. This can be accomplished by furnishing the vest 10 in many different sizes corresponding, for example, to shirt sizes and also preferably by providing the vest 10 with sufficient elasticity, e.g., by forming it either partially or completely from an elastic fabric so that it conforms to the body contours with at least one heated pouch in close proximity to the skin. It is preferred, however, to provide adjustable straps 26 and fasteners 28 such as Velcro® as shown so that only one or two vest sizes will accommodate most individuals and maintain each of the pouches in heat conductive relationship with the body.

On the front panel 14 of the vest 10 are provided two centrally located, vertically aligned pouches 30 and 32, one positioned above the other and each adapted to receive one air-activated flexible chemical heating packet 34 (FIG. 3). It will be seen in FIG. 2 that the upper heating packet 34 contained in pouch 30 is positioned adjacent to the core portion of the body where the heart H and lungs L are located. The packet 34 contained in the pouch 32 is located adjacent to and in heat conductive relationship with the abdomen and particularly the upper portion of the abdomen for conducting heat to the torso. Heat conducted to the core portion of the body in this manner will be distributed throughout the body including the extremities through the circulation of blood.

Each of the pouches 30, 32 has an upper open slit-like opening 36 which is held shut after the packet 34 has been inserted by means of mating hook-and-loop fasteners such as Velcro fasteners 38. Each of the pouches 30, 32 is formed by providing a rectangular patch of cloth that forms a cloth layer 40 which is held in place on the inside of the panel 14 by sewing at 41 along its side and bottom edges.

The back panel 16 of the vest 10 includes a back heating pouch 42 formed by a rectangular piece of fabric 44 which is held in place by means of sewing 46 along the side and bottom edges so as to leave a slit-like upper opening 48 which is sealed after a heating packet 50 is placed in the pouch 42 by means of a suitable fastener such as mating hook-and-loop fastener strips 52.

The pouches 30 and 32 can be about 6 inches wide and 5 inches high for holding a disposable heating packet 34 that is about 4 inches wide by 3 inches high. The pouch 42 can be of a larger size, for example 9 inches high by 11 wide for holding a commercially available disposable air-activated flexible heating packet 34 that is 8 inches wide and 10 inches high.

We have found that the heat requirement varies widely for different individuals under a variety of conditions. The present invention is nevertheless highly effective in providing different amounts of heat to any of several parts of the body. If one is chopping wood, for example, the requirement for heat may be relatively small and in which event it may be desirable to place only one of the smaller packets 34 in one of pouches 30 or 32. Heat is probably carried to the extremities faster from the pouch 30 than the pouch 32 because of the greater vascularization of the upper portion of the thorax and the proximity of the heart and lungs to the pouch. If the individual is doing less work or if the weather is more severe, the body tends to cool off more rapidly. In such a case, the user can place an additional heating packet 34 in the pouch 32 so that both the upper and lower pouches 30, 32 are heated. However, if it is desired to provide heat further down on the thorax, a packet 34 can be placed only in the lower pouch 32. If the weather becomes colder, a larger sized heating packet 50 can be placed in the rear pouch 42. The heating pouches 30, 32, 42 can be used in any combination or all can be used simultaneously to provide the greatest amount of heat to the core of the body. If less heat is desired, the straps 26 can be loosened to allow the pouches 30, 32, 42 to be spaced somewhat further away from the skin and thereby reduce the amount of heat conducted to the body. If desired, the packets 34, 50 can be removed altogether but the vest 10 will still keep the user warm because of its insulating properties.

Figure 9:
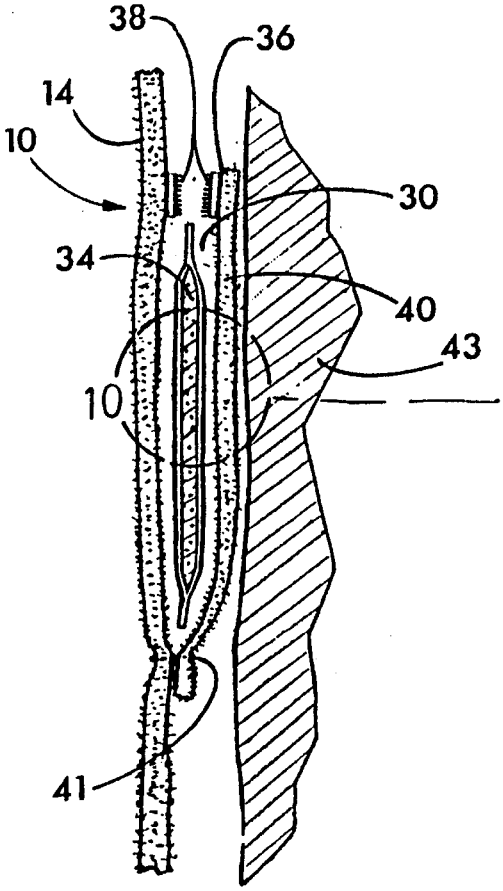
FIG. 9 is a vertical sectional view taken on line 9—9 of FIG. 1.
Figure 10:
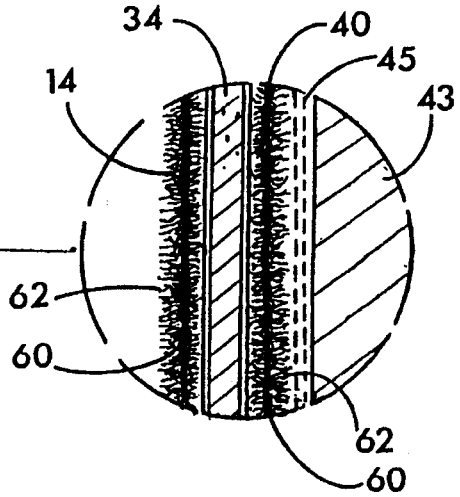
FIG. 10 is an enlarged cross-sectional view of the center portion of the cross-sectional view shown in FIG. 9.

Refer now to FIGS. 9 and 10. it is preferred that the entire vest 10, including panels 14, 16 and the patches which make up layer 40 that form the pouches 30, 32 and the patch 44 that defines the pouch 42 all be formed from a soft, high pile cloth that is porous and has good air trapping qualities. By the term "high pile" is meant a fabric that has a woven or knitted base 60 (FIG. 10) with fibers 62 that extend outwardly therefrom so that the cloth has an overall thickness of at least about 1.5 mm and most preferably about 2.0 mm to about 5.0 mm. It is especially preferred to use a soft cloth such as a fluffy, fleece-like cloth which typically has a thickness of about 4.0 mm. Another suitable cloth is a knitted cloth such as a knitted wool, Orlon or polyester cloth. If a fluffy fleece-like cloth is used, one suitable cloth is a poly/acrylic fleece or a poly/cotton fleece cloth such as that distributed by Menra Mills Corporation, Rutherford, N.J. or Dyersberg Fabrics, Inc., New York, N.Y. It has been found that if a high pile cloth is used as described herein for the layer 40 between the body 43 and the heating packet 34, the high pile layer 40 will serve to control heat distribution by acting as a means for modulating or diffusing the heat supplied by the packet 34, thereby distributing the heat more evenly and gently to the body 43. By contrast, if a thin cloth such as ordinary cotton broadcloth of the type used in a cotton bed sheet is employed, the heat will usually be distributed so rapidly as to cause overheating of the skin and discomfort for the user. However, if a high pile cloth is employed, and most preferably a fluffy fleece-like cloth is used as described herein, the heat will be diffused and distributed in a controlled way, thereby modulating the distribution of the heat to the body and assuring comfort for the user. In FIG. 10, numeral 45 designates an article of clothing such as a shirt between the fabric layer 40 and the body 43.

The provision of a plurality of pockets in different locations serves as a means for shifting the heat-producing packet 34 from one location to another to achieve the desired heating effect for maximizing user comfort. In this way the vest 10 provides heat to the body in a convenient, comfortable and efficient way through the use of heat-producing packets 34 held in selected locations, all in heat conductive relationship with the body. The straps 26 and fasteners 28 are highly effective in holding the vest 10 in place and tightening the sides of the vest 10 to maintain the pouches 30, 32 and 42 close to the body. In addition, the vest 10 provides heat to specific areas of the body for heating the body core without providing excess heat, discomfort or a burning sensation. The invention also enables the heating packets to be quickly, easily and conveniently removed and replaced whenever desired. This is important since the heating packets will usually produce heat for only about 18 hours. If desired, by reversing the front and back panels 14, 16 of the vest 10 on the body, the positions of the large and the small pouches can be changed so that the large pouch 42 rests against the chest and upper portion of the abdomen and the two smaller pouches 30, 32 rest against the back of the body.

It will be noticed that the preferred vest design illustrated is substantially different from an ordinary vest which opens in front, typically by means of a row of buttons. By contrast, the present invention provides a vest 10 with solid front and back panels 14, 16 which support the heat-producing pouches against the center of the chest and back.

The vest 10 is formed so that even without the heat-producing packets 34 or 50 it will provide warmth for the user, thereby enhancing user comfort with or without the heater packets 34 or 50. In this way the invention provides a form-fitting vest 10 that permits direct contact of each of the heating pouches 30, 32, 42 containing the heating packets 34 or 50 with the outer surface of clothing such as a shirt, i.e., with the body, to make effective use of the heat producing packets 34 and 50 without causing discomfort.

Figure 3A:
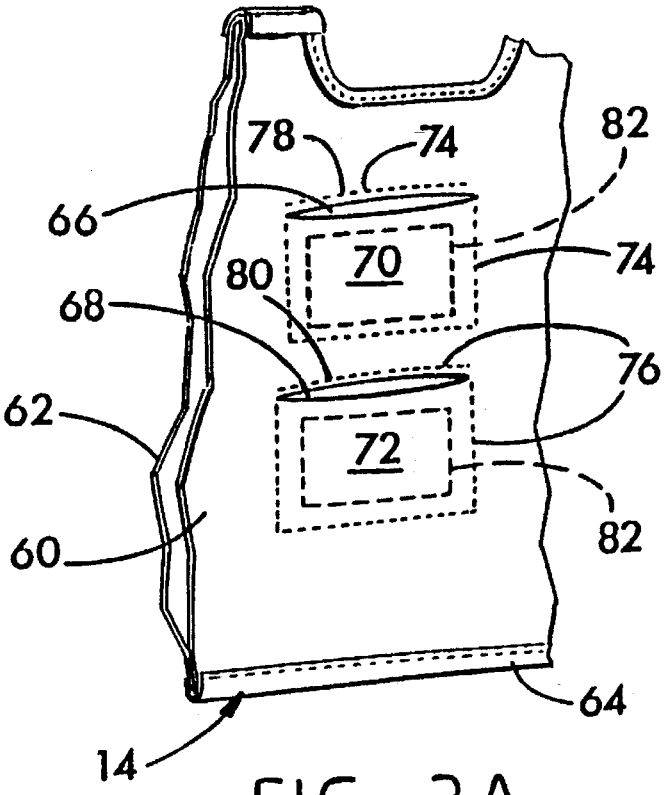
FIG. 3A is a partial perspective view of the inside of the front panel of another form of vest.

Refer now to FIG. 3A which illustrates a modified form of the invention. In this form of the invention at least the front panel 14 of the vest 10, which in this view is seen from the inside, is composed of superimposed inner and outer layers of cloth 60 and 62, respectively. The inner layer 60 is preferably composed of a soft, high pile fabric such as a polyester acrylic fleece to give it a soft, fluffy feeling and to provide an air trapping capability, especially by trapping air between a large number of closely spaced minute fibers which extend from the center of the layer of cloth outwardly toward its surface. One suitable woven fleece-like fabric has an overall thickness of about 4.0 mm. The outer layer 62 is a different material, in this case a relatively thin, tightly woven cloth such as nylon or polyester cloth with no pile. One suitable cloth is a lightweight nylon cloth of the type used in a parachute or windbreaker. The back panel 16 (not shown in this view) is similarly formed with a tightly woven outer cloth layer 62.

The cloth layers 60, 62 are held together along their edges by means of a hem 64, only a part of which is shown. The inner fleece layer 60 is provided with two vertically spaced apart, horizontally extending slits 66 and 68 that define the opening of pouches 70 and 72 formed by two U-shaped lines of stitching 74 and 76 between layers 60 and 62. Horizontal lines of stitching 78 and 80 above the slits 66 and 68 complete the pouches which during use are filled with flexible, air-activated chemical heating packets 82. The heating packets 82 can be used either singly to provide heat to the desired part of the torso or together under colder conditions to provide heat to both upper and lower portions of the abdomen. A single heating packet 82 can be used in either the top pouch 70 or the bottom pouch 72 as desired. The provision of a plurality of pouches serves as a means for allowing the heat producing packets 82*f* to be shifted from one position to another in the garment for delivering heat to different parts of the body and thereby provide optimum comfort for the user.

Figure 4:
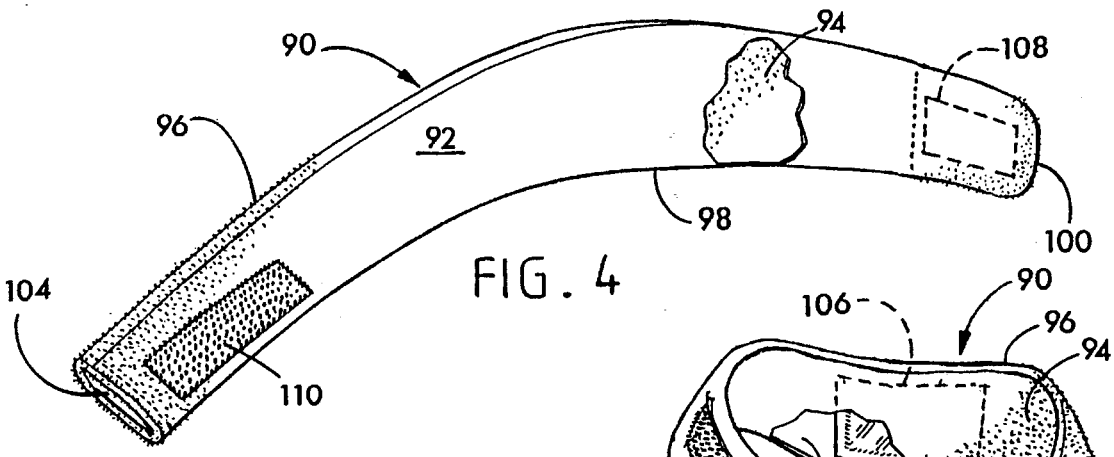
FIG. 4 is a plan view of a neck wrap in accordance with one form of the invention as it appears when laid flat.
Figure 4A:
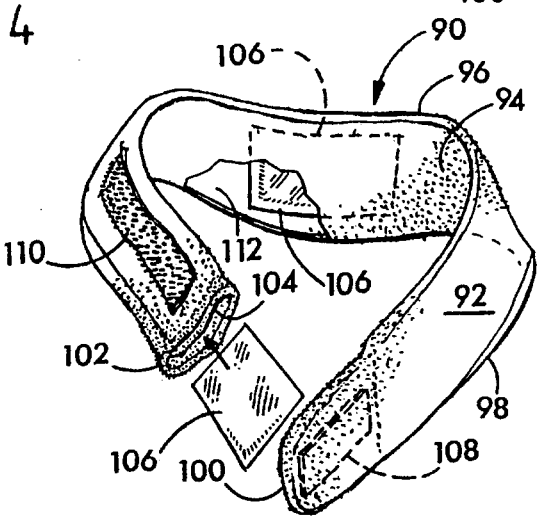
FIG. 4A is a perspective view of the neck wrap of FIG. 4 as it appears when being readied for use.

Refer now to FIGS. 4 and 4A which illustrate another embodiment of the invention. In this case the garment (also shown at 12 in FIGS. 1 and 2) is in the form of a neck wrap or scarf 90 which consists of a pair of elongated strips of cloth 92 and 94 sewn together along parallel longitudinally extending edges 96 and 98. It can be seen from FIG. 4 which illustrates the pattern of the neck wrap 90 that the strips 92, 94 are curved somewhat. One end of the neck wrap 90 is sewn shut at 100 while the other end 102 is left unsewn to provide an opening 104 for the insertion of a chemical heating packet 106 of the type already described. The opening 104 is about 2; inches long to allow insertion of a heat producing packet 106 that is about 2 inches wide by 3 inches long.

The ends of the neck wrap 90 are provided with suitable releasable fastening means such as mating hook-and-loop (Velcro®) strips 108 and 110 on upper and lower surfaces, respectively, of the neck wrap 90. In this way, the neck wrap 90 is provided with a flattened elongated interior pouch 112 that allows the heat generating packet 106 to be shifted to the left or right as desired to provide heat to whatever part of the neck is desired. if desired, two or more heating packets 106 can be placed in the neck wrap 90 and each shifted from side to side to provide heat to whatever part of the neck is desired. During use the Velcro® fasteners 108, 110 are joined together and placed most conveniently just above the sternum as shown in FIGS. 1 and 2 so as to hold the neck wrap 90 securely and snugly around the neck. The heat transferred to the core of the body in this manner will be carried throughout the body by the circulation of blood, particularly in this case by the carotid artery passing through the neck. The elongated shape of the pouch 112 serves as a means for shifting the heat producing packets 106 within the garment to different positions in heat transfer relationship with different parts of the body for delivering heat so as to provide optimum heating and comfort for the user.

Figure 5:
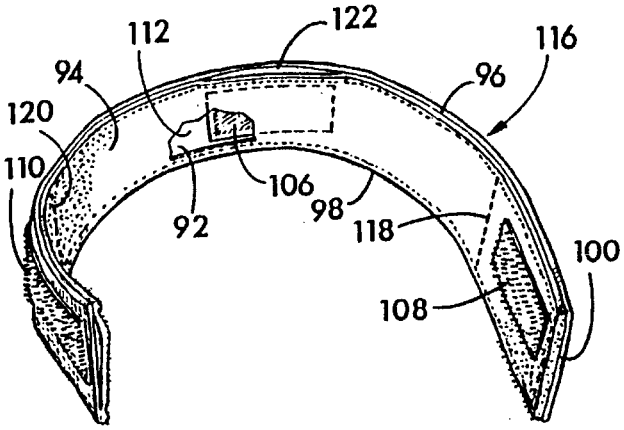
FIG. 5 is a perspective view of another form of neck wrap as seen before being placed about the neck.

Refer now to FIG. 5 which illustrates a different form of neck wrap wherein the same numerals refer to corresponding parts already described in FIGS. 4 and 4A. Positioned just centrally of the Velcro® fasteners 108 and 110 in this embodiment are transverse rows of stitches 118 and 120 which define the ends of the pouch 112. The stitches 118 and 120 prevent the heating packets 106 from being shifted into either end of the neck wrap 116 adjacent to the Velcro® fasteners 108 and 110. One or more flexible heating packets 106 are inserted into the neck wrap 116 through a longitudinally extending opening or slit 122 which can be about 2 inches long and may simply comprise an interruption in the seam 96.

The neck wrap 116 can be about 34 inches long and 3 inches wide, permitting as many as several heat producing packets 106 measuring 2 inches by 3 inches to be inserted and positioned at various locations around the entire circumference of the neck. This places the packets 106 in heat conductive relationship with the body for transferring heat efficiently to the body core. The slit 122 can be positioned approximately intermediate the ends of the neck wrap 116.

It is preferred that the outer and inner fabric strips 92, 94 comprise a soft, flexible and comfortable fabric such as a fluffy fleece-like cloth. One preferred fabric is a poly/acrylic fleece-like fabric or a poly/cotton fleece-like fabric of the type described above in connection with the vest 10 of FIGS. 1–3A.

The neck wraps 90, 116 provide extra warmth when the heat producing packet 106 is used, but even without the packets 106 continue to protect the neck from cold and thereby provide additional warmth after the heating packet 106 has been used up.

Figure 6:
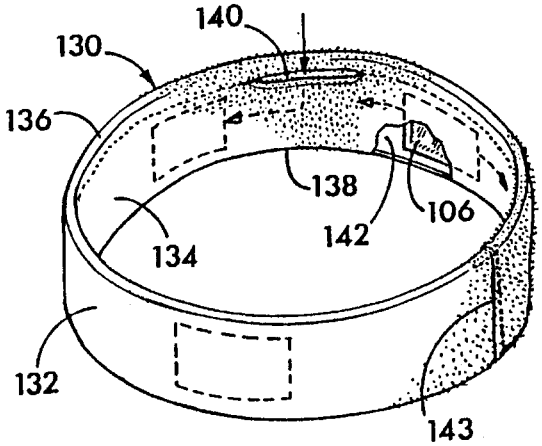
FIG. 6 is a perspective view of a heated headband in accordance with the invention.
Figure 6A:
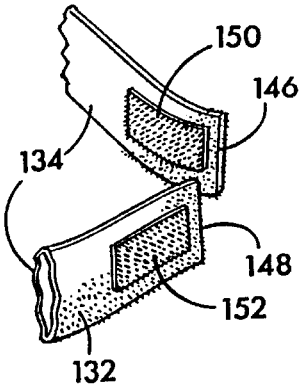
FIG. 6A is a partial perspective view of a modified form of the headband.

Another garment embodying the invention is shown in FIG. 6 and in a modified in FIG. 6A. In this case the garment indicated at 130 comprises a headband composed of inner and outer fabric strips 132, 134 which are joined together along aligned edges by means of upper and lower seams 136, 138. The headband 130 is most preferably composed of a fabric known in the art as stretch fleece. The upper seam 136 has an opening 140 in the form of an elongated slot for inserting and removing air-activated chemical heating packets indicated at 106 of the same type already described from a pouch 142 located between strips 132 and 134. The invention has the advantage that the packets 106 can be shifted from left to right as desired within the elongated annular pouch 142 between the inner and outer fabric strips 132, 134 to thereby position one or several heating packets 106 to whatever position is desired by the user to provide efficient heat transfer to the body core while providing the greatest possible comfort. The ends of the strips 132, 134 are stitched together by means of a transverse seam 145.

The cloth strips 132, 134 are preferably composed of a high pile cloth as described above or, if desired, a knitted cloth such as a high pile knitted wool or Orlon cloth, preferably with a fuzzy, fleece-like surface texture to provide a great deal of comfort and warmth for the user even after the packets 106 have become inactive. Moreover, the dead air spaces within the high pile fabric of the inner strip 134 will serve to diffuse the heat and thereby modulate the transfer of heat from the packets 106 to the body in such a way as to keep the body warm while preventing overheating of the skin or a burning sensation which is, of course, unacceptable.

It has been found that because of the friction between the pouch 142 and the packets 106, and because adjacent layers of the pouch 142 are ordinarily in contact with one another, the heating packet 106 will almost never move from the desired position in the pouch 142.

Refer now to the modified form of the invention shown in FIG. 6A wherein the same numerals refer to the same parts already described. In this embodiment the ends of the headband 130 are not connected together by the seam 143. In this case, the ends of the headband 130 are sewn shut by transverse seams at 146 and 148. The ends of the headband 130 are provided with suitable releasable fastening means such as mating Velcro® strips 150, 152 on the inner and outer surfaces which are joined together during use to hold the headband 130 in place with the inner strip 134 in contact with the head and ears. The Velcro® fasteners 150, 152 allow for size adjustment to provide a snug fit so as to easily fit various size heads for maximizing user comfort. By shifting the packets 106 from left to right within the pouch 142 they can be placed in the center of the forehead, at the back of the head, or over the ears as desired by the user. Several packets 106 can be inserted to provide a ring of warmth extending around the entire head. The elongated pouch 142 serves as a means for Shifting the packets 106 within the garment to different positions in heat transfer relationship with different parts of the body for distributing heat to provide optimum heating and comfort for the user.

Figure 7:
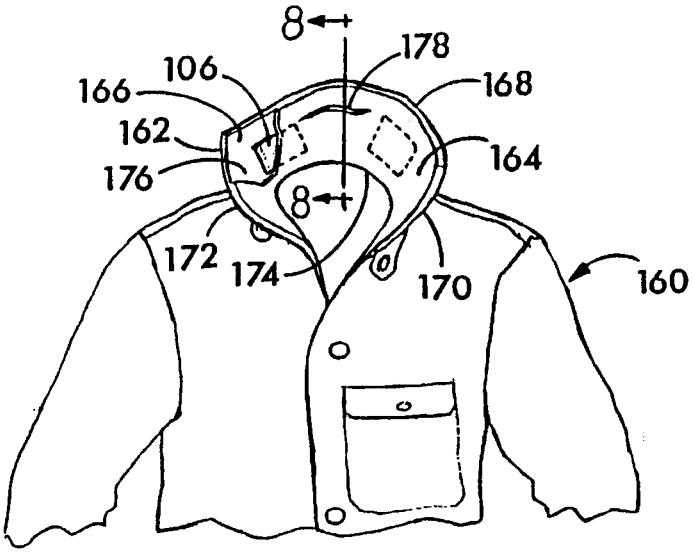
FIG. 7 is a partial front elevational view of a jacket embodying the invention.
Figure 8:
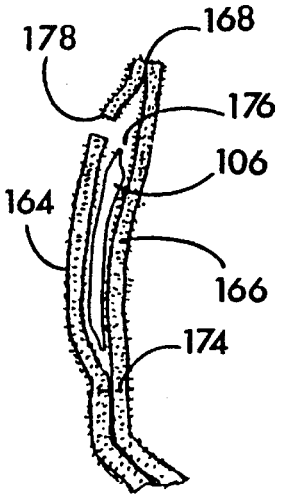
FIG. 8 is a vertical sectional view taken on line 8—8 of FIG. 7 on an enlarged scale.
Figure 7A:
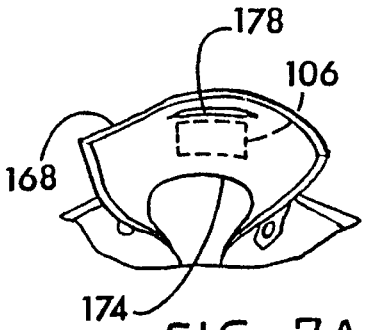
FIG. 7A is a partial perspective view of the collar of the jacket of FIG. 7 showing alternate heater positions.

Refer now to FIGS. 7–8 which illustrate a modified form of the invention, in this case a winter jacket which includes a collar 162 formed from inner and outer fabric layers 164 and 166, respectively, joined together by means of a top seam 168, left and right upright seams 170, 172 and a transversely extending neck seam 174 which is parallel to the top seam 168. Extending from side to side between the inner and outer fabric layers 164, 166 is a transversely elongated pouch 176 for holding one or more heating packets 106 which are inserted just before use through a transverse slit 178 that can be about 2½ inches long near the top of the inner fabric layer 164. The heat producing packets 106 can be placed one on each side as shown in FIG. 7 or, if desired as shown in FIG. 7A, a single packet 106 can be provided and placed in the center of the collar 162. The packet 106 can be shifted laterally to whatever position is most comfortable for the user. The collar 162 can be formed from any suitable fabric, with the inner fabric layer 164 preferably formed from a high pile cloth such as a fleece-like fabric cloth or woolen cloth. The most preferred cloth is a polyester/acrylic fleece or polyester/cotton fleece. The outer layer 166 is preferably a woven or knitted fabric that is similar to the outside of other portions of the jacket to provide a good match.

During use, the heating packet 106 provides heat efficiently and comfortably to warm the neck of the person wearing the jacket 160. The heat is carried by blood circulation throughout the body.

The jacket 160 and the other garments described above hold the packets 106 in place adjacent to the skin and in good heat conductive relationship with the body while allowing free, unimpeded movement during a variety of physical activities. The garments also allow the heat producing packets 106 to be readily replaced when used up. In addition, the garments can be manufactured using high speed and low cost mass production methods. The invention thus provides an economical and cost-effective means of furnishing heat to the core of the body.

Figure 11:
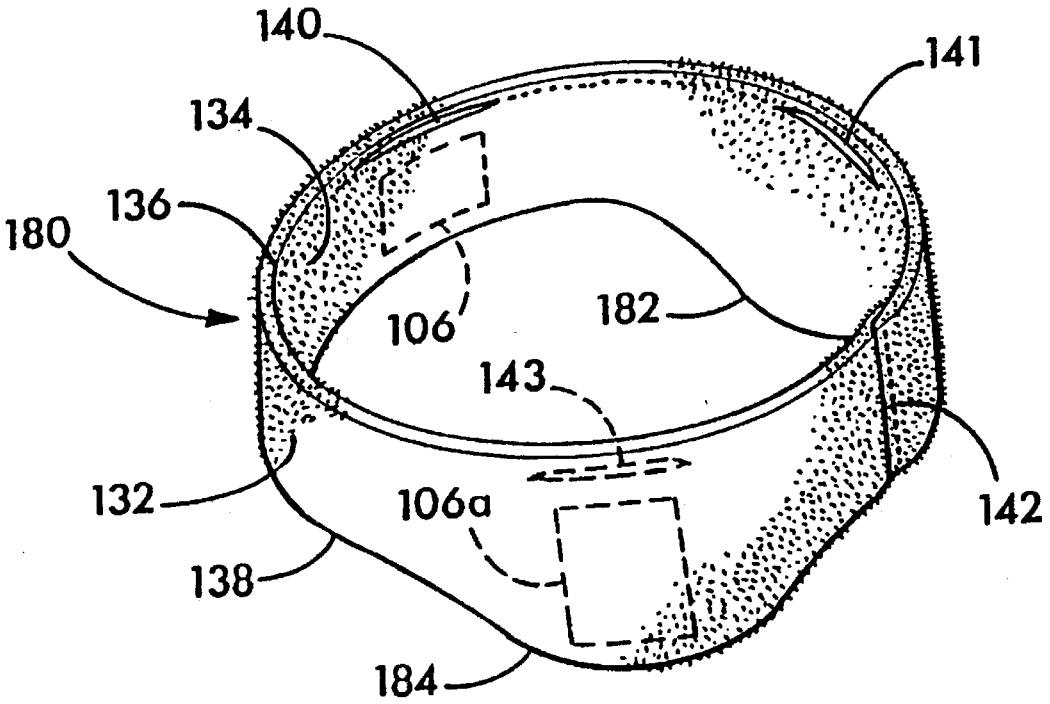
FIG. 11 is a perspective view of another form of headband in accordance with the invention.

Refer now to FIG. 11 which illustrates another form of headband 180 wherein the same numerals refer to corresponding parts already describe in connection with FIG. 6. The headband 180 has three heating packet insertion slits 140, 141 and 143 to permit insertion of the heat-producing packets 106 at various locations within the headband 180. The headband 180 also includes a pair of opposed downwardly depending ear flaps 182, 184 for covering the ears. The slits 141, 143 are positioned immediately above the ear flaps 182, 184, respectively, to facilitate insertion of the heat-producing packets such as packet 106*a* into the ear flap section 184. The headband 180 can be formed from any of the fabrics described above or from a variety of other fabrics that will be apparent to those skilled in the art.

Figure 12:
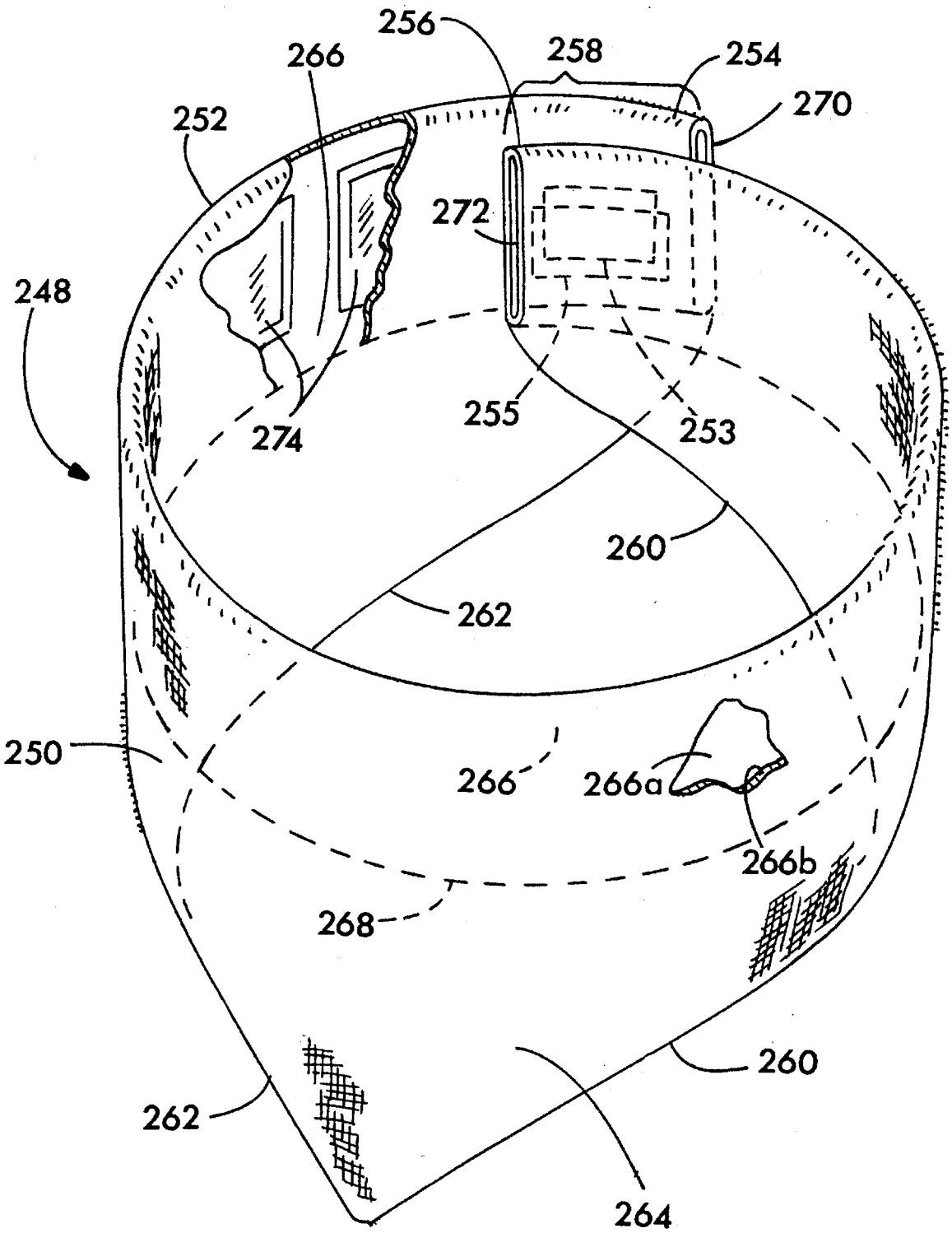
FIG. 12 is a perspective view of a heating bandanna to be placed around the neck of the user in accordance with another form of the invention.

Refer now to FIG. 12. Shown in FIG. 12 is a heating bandanna 248 comprising a piece of cloth 250, in this case a piece with a generally triangular shape having an upper edge 252 adapted to extend during use generally horizontally and to encircle the neck of the wearer with opposing ends 254, 256 overlapped and releasably joined together at 258 by means of mating releasable fasteners such as Velcro® fasteners 253, 255. The heating bandanna 248 also has depending edges 260, 262 that extend downwardly from the opposing ends 254, 256 so as to define between them a body-covering flap 264. An elongated horizontally extending pouch 266 is provided for receiving one or more heating packets of about the same height but of a much smaller width than the pouch 266. The pouch 266 has a lower edge 268 that is generally parallel to the upper edge 252 where the walls 266*a* and 266*b* of the pouch 266 are joined together at the bottom of the pouch 266. The pocket 266 has openings 270, 272 at its ends for inserting and removing heating packets 274 of the kind already described. The flap 264 can be positioned to cover the chest during use, or even the back if desired. The elongated pouch 266 is tube-like, allowing the much smaller heating packets 274 to be slid laterally by manipulating the packet from the outside either to the left or right to different positions in the pouch 266 to provide heat to the desired location on the body of the user. Once positioned, the packets 274 will remain in place.

Figure 13:
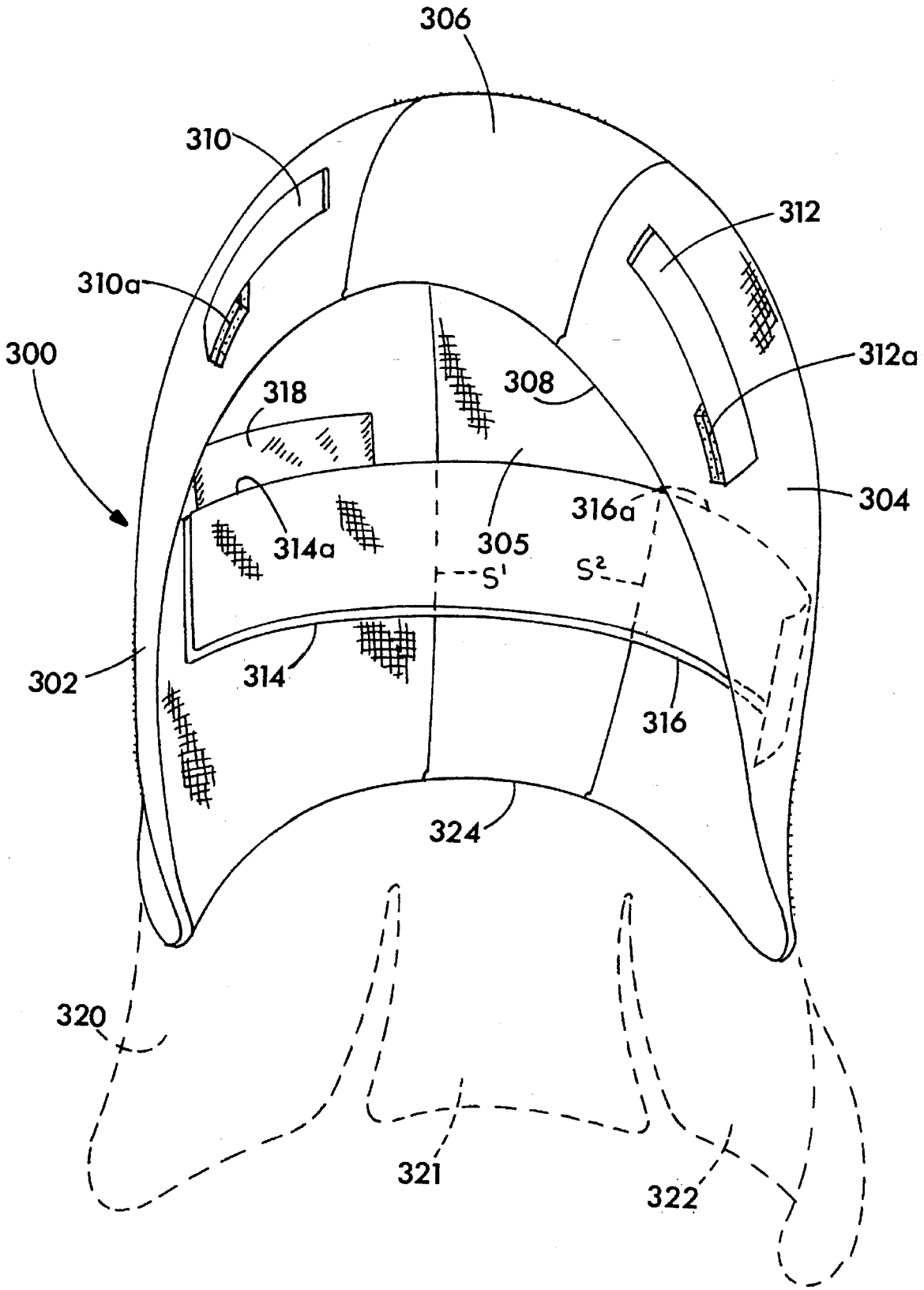
FIG. 13 is a perspective view of a hat liner to be placed inside a hat such as a construction worker's hard hat.

Refer now to FIG. 13. The garment shown in FIG. 13 is a head covering, in this case a hat liner 300 for a hat such as a construction worker's hard hat (not shown). The hat liner 300 is formed from cloth and has spaced apart side panels 302 and 304, a top panel 306, a rear panel 305, and a face opening 308. Fasteners, such as straps 310 and 312 sewn to the hat at their upper ends and held in place at their lower ends by a releasable connecting means such as Velcro® strips 310*a* and 312*a*, are used to secure the hat liner 300 in place inside the hat (not shown) by being looped around a support element (not shown) on the inside of the hat. The hat liner 300 is also provided with at least one pouch adapted to hold chemical heating packets 318, for example at 314, 316. In this case there are openings as at 314*a* and 316*a* to receive heat-producing packets 318 which are inserted and removed through the top openings 314*a* and 316*a*. The vertical seams $S^1$ and $S^2$ are optional, and when not used allow the heating packet 318 to be shifted from side to side within the pouch 314, 316. If desired, cloth neck flaps 320, 321 and 322 depend from the lower edge 324 of the hat liner 300 to help protect the neck of the wearer during use. The cloth used in the embodiments of FIGS. 12 and 13 can be the same as that described above in connection with FIGS. 1–11.

Figure 14:
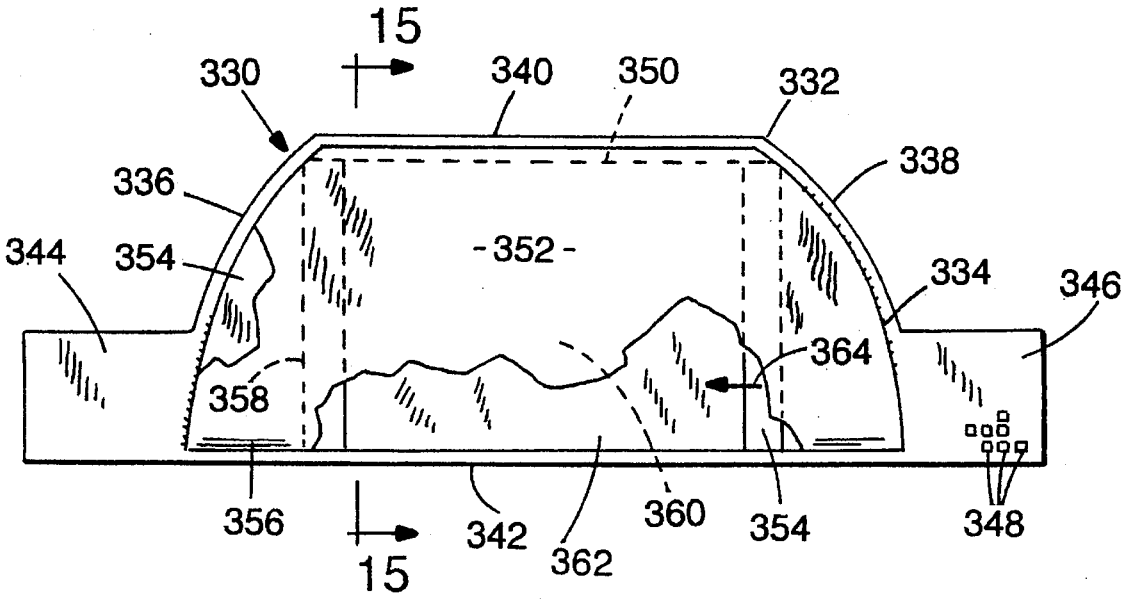
FIG. 14 is a side view of a cap or hat insert in accordance with the present invention.
Figure 15:
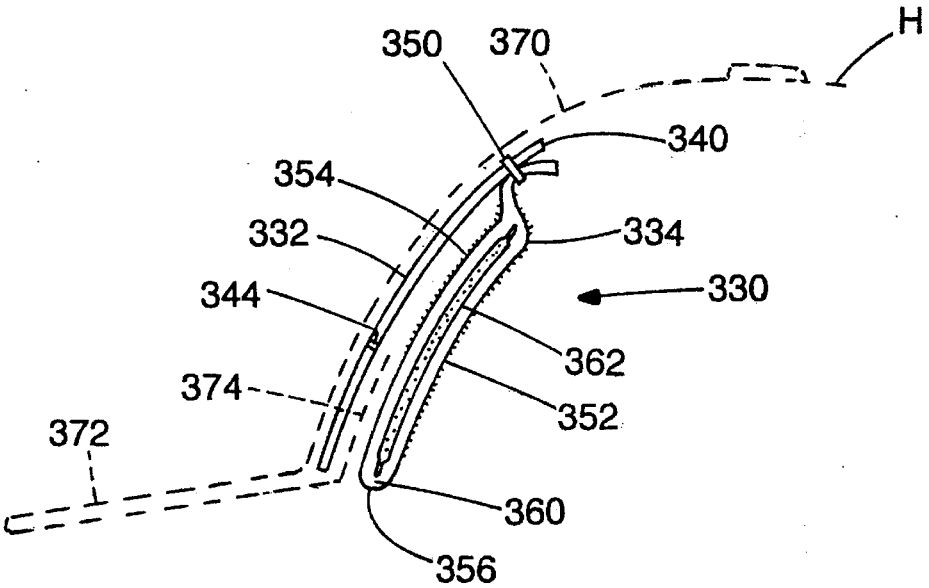
FIG. 15 is a vertical sectional view taken on line 15—15 of FIG. 14 showing the detachable hat or cap insert in place within a cap.

Refer now to FIGS. 14 and 15 which illustrate another form of the invention, in this case an insert to be placed in a cap or hat for accommodating an inserted heating packet. The insert indicated generally by the numeral 330 includes two major components: a stiff backing sheet or support member 332 which functions somewhat in the nature of a supporting bracket, and a pouch 334 which is formed from the same kind of soft and preferably fluffy cloth already described. The supporting member 332 preferably comprises a sheet of stiff but bendable material such as a heavy sheet of polyethylene having curved side edges 336, 338, upper and lower edges 340, 342 and horizontally extending tabs 344, 346 that project laterally on each side. The stiff supporting member 332 can be formed from any suitable lightweight sheet material that is somewhat stiff but capable of being flexed enough to conform to the contours of the head, in this case the forehead. A sheet of 20 mil. polyethylene can be used, with or without openings throughout its length and breadth such as the openings 348 (FIG. 14) to define a mesh structure to enhance ventilation.

The pouch 334 is connected to the supporting member 332 by means of a horizontal row of stitches adjacent to the horizontal upper edge 340 of member 332 and pouch 334. The pouch 334 has an inner wall 352 and an outer wall 354 connected along a fold line 356 at the lower edge of the pouch 334 to provide a compartment or chamber 360. Both inner and outer walls 352, 354 are connected to the supporting sheet 332 by means of the stitches 350. The walls 352, 354 of the pouch 334 are also connected by a vertical row of stitches 358 to form the left end of a chamber 360 for receiving a chemical heating packet 362.

When the heating cap insert 330 is to be used it is placed within a cap H having a crown 370 and a bill 372 (seen from the side in FIG. 15). The cap H also includes the usual sweatband 374 which extends around the inside of the cap H and is connected to the lower edge of the crown 370. The lower portion of the supporting member 332 is placed between the crown 370 of the cap H and the sweatband 374 as shown in FIG. 15 so that the tabs 344, 346 project laterally on each side of the bill 372 in the space between the sweatband 374 and the crown 370 of the cap H. The pouch 334 hangs from the row of stitches 350 and, as shown in FIG. 15, lies inside the sweatband 374 so that it contacts the forehead. When heat is to be provided, an air-activated chemical heating packet 362 is inserted as shown by the arrow 364 (FIG. 14) into the chamber 360 between the layers of cloth 352 and 354 as shown in FIG. 15.

During use, the hat or cap, which in this case happens to be a baseball-style cap, holds the insert 330 with the pouch 334 on the inside of the cap in contact with the user's head. It will be noticed that the soft cloth layer 352 will contact the forehead of the user in this case, providing a soft, flexible inner surface. If a fluffy, fleece-like cloth is used, the insert 330 will provide even greater comfort for the user than when the hat is used without it. One preferred cloth is a poly/cotton fleece-like cloth of the kind described in connection with the embodiments of FIGS. 1–3A or any of the other embodiments herein. When the chemical heating packet 362 is inserted into the chamber 360, the insert 330 will provide extra warmth for the user. However, even when no heating packet 362 is used or is not functioning, the insert 330 will provide additional protection from the cold, thereby providing additional comfort for the user after the chemical heating packet 362 no longer produces heat.

The invention makes it possible for the user to be more comfortable than in previous garments owing primarily to the ease with which the heating packets can be moved to any position desired to assure the greatest degree of comfort, especially by shifting the heating packet manually within a single pouch which is larger than the heating packet itself. This can be done by manipulating the heating packet within the pouch entirely from the outside; that is to say, by grasping the cloth around the heating packet, sliding the cloth manually along the surface of the heating packet so that wrinkles form in the cloth, and then sliding the heating packet sideways in the pouch which is substantially longer than the width of the heating packet. This operation is repeated as many times as is necessary to slide the heating packet from one end of the pouch to the other or to whatever position is desired. The heating packets can be moved within the pouches to any desired position entirely from the outside so that if the heating packet begins to feel too warm or uncomfortable to the user because it is producing too much heat in one area, it can be moved to another area. In other circumstances when some part of the body begins to feel cold, the heating packet can be easily moved to the exact area to do the most good. A heating packet can also be moved to an infinite number of in-between points within a pouch. Because the pouch extends horizontally, the heating packet will stay where it is placed.

Many variations of the present invention within the scope of the appended claims will be apparent to those skilled in the art once the principles described herein are understood.

What is claimed is:

1. A heating garment in combination with an inserted air-activated chemical heating packet that can produce overheating or a sensation of burning of the skin comprising, a garment article formed from cloth for covering a portion of the body, said garment article being flexible and sufficiently supple to conform to the body contours, said garment article having inner and outer adjacent layers of cloth forming a pouch therebetween for receiving and supporting the heating packet therein, each pouch has an opening to enable the heating packet to be inserted into the pouch before use and removed after use, said air-activated chemical heating packet comprises a flexible packet containing chemically reactive substances that provide an exothermic chemical reaction which increases the temperature of the packet to about 130° F. to 140° F. to provide heat for up to about 18 hours, at least the inner layer of cloth of the pouch is a porous layer positioned between the heating packet and the person's body and comprising a high pile cloth including a multiplicity of fibers extending from a portion of the cloth for holding trapped air to control heat distribution by diffusing the heat supplied by the chemical heating packet to the body to enhance the comfort of the user, the pouch is elongated horizontally to provide a passage that is substantially longer than the width of the chemical heating packet and extends in a generally horizontal direction when the garment is in use to support the heating packet so that the packet will rest in the pouch wherever it is positioned therein, the heating packet is smaller than the pouch which extends substantially from one end of the garment to the other and the elongated shape of the pouch serves as a means for enabling the relatively smaller heating packet to be shifted within the garment to different positions throughout substantially the entire length of the garment in heat transfer relationship with different selected parts of the body for distributing heat to different points for providing optimum warmth and comfort for the user, and the friction between the pouch and the packet holds the heating packet in the desired position in the pouch.

2. The garment of claim 1 wherein the pouch is open at both ends so the heating packet can be inserted and removed through an opening at either end of the garment.

3. The garment of claim 1 wherein the high pile fabric comprises a fleece-like fabric.

4. The garment of claim 1 wherein the high pile fabric comprises a knitted fabric.

5. The garment of claim 1 wherein the garment comprises a head protective garment for at least partially covering the head of a user, and the pouch is a pouch means with portions on each side of the head for allowing at least one chemical heating packet to be placed adjacent to each side of the head proximate to each ear.

6. The garment of claim 1 wherein the garment is a hat liner to cover the head, said liner has side portions, a top portion, a rear portion, and a face opening, said hat liner has fasteners thereon for securing the hat liner to a hat by being connected to a portion of the hat, and said pouch means holds said heating packet in heat conductive relationship with the head during use.

7. The garment of 6 wherein the pouch means of the hat liner has a compartment positioned proximate to each ear of the wearer during use.

8. The garment of claim 1 wherein the garment is a detachable cap or hat insert having inner and outer adjacent layers of cloth connected along upper and lower edges to define a chamber therebetween for holding a chemical heating packet, means connected to the pouch for attaching the pouch to a cap or hat with a sweatband, and the cap or hat insert is supported upon the inside of a cap during use with the pouch positioned between a portion of the hat and head of the user and said pouch has an opening therein for inserting and removing a chemical heating packet from the pouch, the attaching means is a supporting member formed from stiff sheet material including upper and lower edges, the lower edge of the supporting sheet extends laterally of the cap between the crown of the cap and the sweatband of the cap, and the pouch is connected to the supporting sheet above the sweatband of the cap or hat whereby the pouch depends downwardly on the inside of the cap or hat from said upper portion of the supporting sheet.

9. The garment of claim 8 wherein the pouch has rounded left and right side edges so that when the cap or hat insert is mounted within the front of the cap or hat the insert contacts the forehead of the user for providing warmth and comfort for the head, the supporting sheet includes openings therein to define a mesh structure to enhance ventilation, the supporting sheet is connected to the pouch by a horizontally extending row of stitches proximate to the upper edge of the pouch and the supporting sheet whereby the pouch depends from the row of stitches so that a lower portion of the pouch is positioned between the sweatband of the cap or hat and the head of the user and in contact with the head of the user for keeping the forehead from touching the sweatband, and the supporting sheet holds the heating insert in place within the cap or hat when the cap or hat is removed from the head of the user.

10. A heating garment in combination with an inserted air-activated chemical heating packet comprising, a cloth head covering having left and right sides for covering the sides of the head, a top for covering the top of the head, and a rear portion for covering the rear of the head, said garment covering substantially the entire head except for the face and a face opening at the from of the garment, said head covering is flexible and sufficiently supple to conform to the body contours, said head covering has inner and outer adjacent layers of cloth forming a pouch therebetween which extends substantially from one end of the garment to the other for receiving and supporting the heating packet and the pouch has an opening to enable the heating packet to be inserted into the pouch before use and removed after use, the pouch is elongated horizontally to provide a passage that is substantially longer than the width of the chemical heating packet and extends in a generally horizontal direction when the garment is in use to support the heating packet so that the packet will rest in the pouch wherever it is positioned therein, the heating packet is smaller than the pouch and the elongated shape of the pouch serves as a means for enabling the relatively smaller heating packet to be shifted within the garment to different positions throughout substantially the entire length of the garment in heat transfer relationship with different selected parts of the body, said air-activated chemical heating packet comprises a flexible packet containing chemically reactive substances that react to provide an exothermic chemical reaction which increases the temperature of the packet to about 130° F. to 140° F. to provide heat for up to about 18 hours, at least the inner layer of cloth of the pouch has fibers extending from a portion of the cloth, said head covering has fastener means for securing the head covering in place, the pouch holds said heating packet in heat conductive relationship with the head during use, and each such pouch has one of said openings therein for inserting and removing the heating packet from the garment.

11. The garment of claim 10 wherein said pouch means includes compartments positioned in side panels of the head covering proximate to the ears of the user that are automatically aligned with the ears when the garment is in use with the face of the user exposed through the face opening.

12. The garment of claim 10 wherein the head covering is a hat liner and the fastener is a strap having a releasable portion for securing the hat liner within a hat, the elongated shape of the pouch serves as a means for enabling the heating packet to be shifted within the garment to different positions in heat transfer relationship with different selected parts of the body for distributing heat to different points for providing optimum warmth and comfort for the user, and friction between the pouch and the packet holds the heating packet in the desired position in the pouch.

* * * * *